US007361443B2

(12) United States Patent
Yamazaki et al.

(10) Patent No.: US 7,361,443 B2
(45) Date of Patent: Apr. 22, 2008

(54) IMAGE FORMING METHOD

(75) Inventors: Hiroshi Yamazaki, Hachioji (JP); Hiroyuki Yamada, Tsukui-machi (JP); Tomoe Kitani, Hino (JP)

(73) Assignee: Konica Minolta Holdings, Inc. (JP)

( * ) Notice: Subject to any disclaimer, the term of this patent is extended or adjusted under 35 U.S.C. 154(b) by 258 days.

(21) Appl. No.: 10/869,778

(22) Filed: Jun. 15, 2004

(65) Prior Publication Data

US 2005/0277050 A1 Dec. 15, 2005

(51) Int. Cl.
*G03G 15/16* (2006.01)

(52) U.S. Cl. ..... 430/125.3; 430/125.5; 399/319

(58) Field of Classification Search ..... 430/126, 430/124, 125.3, 125.5; 399/319
See application file for complete search history.

(56) References Cited

U.S. PATENT DOCUMENTS 5,081,500 A * 1/1992 Snelling ..... 399/319
5,282,006 A * 1/1994 Fletcher ..... 430/126
6,124,070 A * 9/2000 Baba et al. ..... 430/110.4
2002/0182527 A1* 12/2002 Kim et al. ..... 430/110.4
2003/0219671 A1* 11/2003 Tanma et al. ..... 430/110.4

FOREIGN PATENT DOCUMENTS

JP 2001-100546 4/2001

OTHER PUBLICATIONS

English language Machine translation of JP 2001-100546 (Apr. 2001).*

* cited by examiner

*Primary Examiner*—Christopher RoDee
(74) *Attorney, Agent, or Firm*—Squire, Sanders & Dempsey L.L.P.

(57) ABSTRACT

An image forming method is disclosed. The method includes steps of forming a toner image on an image forming member, transferring the toner image to an image supporting material, by applying an electric field between the image forming member and the image supporting material and irradiating ultrasonic wave to the image forming member and the image supporting material, and fixing the toner image on the image supporting material, and a toner having a volume average particle diameter of from 3 to 8 μm and a content of the toner particle having a diameter of not more than 2 μm being not more than 2% by number is employed.

8 Claims, 2 Drawing Sheets

IMAGE FORMING METHOD

FIELD OF THE INVENTION

The present invention relates to an image forming process in which a static image is formed on an image forming member and the image is transferred onto an image supporting member material fixed.

BACKGROUND OF THE INVENTION

Recently, an image forming method is utilized in almost image forming apparatus to form a high quality image in high speed, in which a static image is formed on an image forming member and is developed by a toner, and thus obtained image is transferred onto an image supporting material and fixed by contacting with a heating means.

In such the image forming method, there is a problem of that deformation of the image is the step of transferring the image developed by the toner to the image supporting material.

As a countermeasure to such the problem, various methods have been proposed such as a sticking transfer, however, have drawbacks regarding the high speed treatment ability, and sufficient transfer efficiency cannot be obtained when the amount of the toner to be transferred is too large. Particularly, it is difficult to entirely transfer the toner image of a color image since the toner amount in the color image is larger than that of a conventional monochromatic image. Consequently, such the problem is become important in the color image formation.

Besides, as a method for improving the transfer utilizing an electric field, a method is proposed in which ultrasonic wave is applied in the occasion of the transfer to raise the transfer efficiency, cf. Japanese Patent Publication Open to Public Inspection No. 2001-100546. This method is effectual since the unevenness of the toner can be avoided and high efficiency transfer can be carried out. In such the method, however, defects are formed sometimes on the image forming member, hereinafter also referred to as the photoreceptor because the image forming member is the photoreceptor in almost cases, and the solution of such the problem has been demanded.

SUMMARY OF THE INVENTION

The object of the invention is to provide an image forming method by which a large amount of toner can be transferred with high efficiency and an image without any defects can be stably formed for a prolonged period. Another object of the invention is to provide an image forming method by which the toner image can be effectively transferred by utilizing the ultrasonic wave.

The invention is described below.

An image forming method comprising the steps of (a) forming a toner image on an image forming member having a photosensitive material on a support including steps of forming a latent image on the image forming member and developing the latent image by a developer containing a carrier and a toner, (b) transferring the toner image to an image supporting material, by applying an electric field between the image forming member and the image supporting material and irradiating ultrasonic wave to the image forming member and the image supporting material by an ultrasonic wave generating device, and (c) fixing the toner image on the image supporting material, wherein the volume average particle diameter of the toner is from 3 to 8 μm, and a content of the toner particle having a diameter of not more than 2 μm is not more than 2% by number.

Preferable embodiments are described.

The toner is preferably a non-magnetic toner.

The toner image on the image forming member is preferably composed of a plurality of different colors in the step (a).

The toner image on the image forming member is preferably composed of yellow, magenta, cyan and black toners.

The frequency of the ultrasonic wave is preferably from 20 kHz to 2 Mhz.

The preferable example of the support is a plastic base having a thin aluminum evaporated layer.

The ultrasonic wave generating device is preferably not in contact with the image forming member.

The content of the toner particle having a diameter of not more than 2 μm is preferably not more than 1.5% by number.

The alternative electric field is preferable.

The developer layer is not preferably contacted to the image forming member in the step (a).

An image forming method comprising the step of conveying an image forming member carrying a toner image thereon into a transfer zone, overlapping an image supporting material so that the toner image is between the image forming member and the image supporting material, applying an electric field between the image forming member and the image supporting material, irradiating ultrasonic wave, on the occasion of the application of the electric field, to the image forming member and the image supporting material from an ultrasonic wave generating means arranged at a facing position so as not to contact to transfer the toner image onto the image supporting material, and then fixing the toner image, wherein the volume average particle diameter of the toner is from 3 to 8 μm, and the content of the toner particle having a diameter of not more than 2 μm is not more than 2% by number.

In the method applying the ultrasonic wave utilizing in the invention, it is presumed that the toner is finely vibrated so that the fine particle components adhered onto the particle surface are released and adhered to the photoreceptor, and the fine particle components cannot be removed by the cleaning treatment and for the matter fused and adhered on the photoreceptor. Particularly, it is presumed that the fine particle component having a diameter of not more that 2 μm is released from the toner particle surface and adhered onto the photoreceptor.

Such the fine particle component of the toner particularly tends to be formed in a toner prepared by a crushing method. The fine particles are contained in the regular distribution of the toner particles formed by the crushing method. Such the fine particles are usually not released from the toner particle and not cause problem of adhesion to the photoreceptor. It is presumed that the fine particles are released and adhered to the photoreceptor surface when the ultrasonic wave is applied.

DETAILED DESCRIPTION OF THE INVENTION

<Diameter of Toner Particles>

Figure 1:
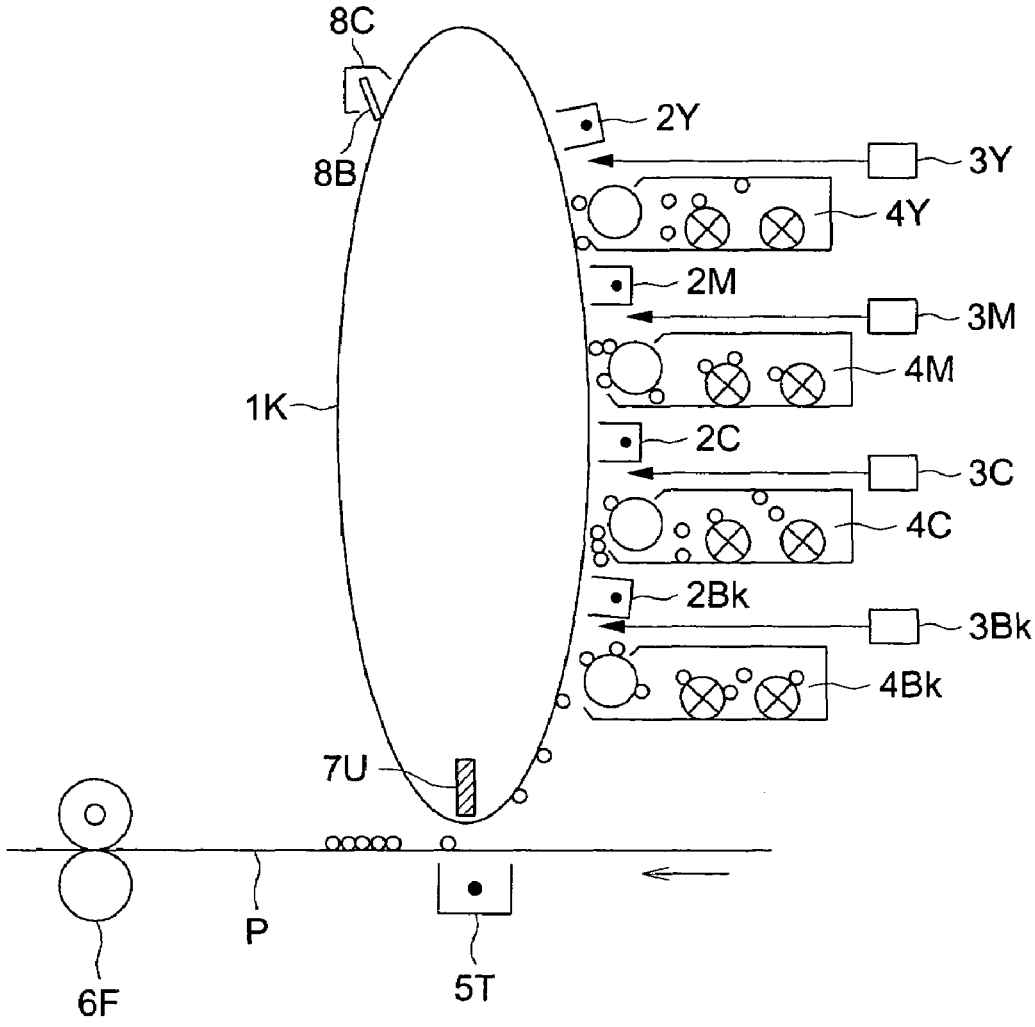
FIG. 1 displays the cross section of a full color image forming apparatus relating to the invention.

The diameter of the toner particles according to the invention is from 3 to 8 μm in volume average diameter. When the toner particles are formed by a polymerization method, the particle diameter can be controlled by the concentration of the coagulating agent, the adding amount of organic solvent, the time for fusion and the composition of the polymer itself in the later-mentioned polymerization method.

When the volume average diameter is from 3 to 8 μm, the thickness of the layer of each of the color toners is not excessively large and the transfer ability of the toner image can be improved. Moreover, the image quality of halftone is raised accompanied with the raising of the transfer efficiency, the quality of fine line and dot image.

The volume average diameter of the toner is measured by Coulter Counter TA-II or Coulter Multisizer, both manufactured by Coulter Co., Ltd. In the invention, the diameter of the toner particle having a diameter of not more than 2 μm is defined by the number percentage by a flow type particle image analyzing apparatus FOIA-2000, manufactured by Toa Medical Electronics Co., Ltd.

In the invention, the content of the toner particle having a diameter of not more than 2 μm is not more than 2% by number. These particles are adhered onto the photoreceptor and cause filming causing image defects. The content is preferably not more than 1.5% by number.

The method for preparing the toner according to the invention is described below.

There is no specific limitation on the toner preparation method in the invention; the toner may be either prepared by the crush method or the polymerization method. However, the polymerization method is preferred for controlling the content of the particle having a diameter of not more than 2 μm to not more than 2% in number by making uniform the particle diameter. An emulsion polymerization method is particularly preferred.

The toner particles can be prepared by a method in which a monomer emulsified in an aqueous medium is polymerized to form fine resin particles and then the fine resin particles are associated by adding an organic solvent or a coagulating agent. The association means the fusion of plural resin particles, which includes the fusion of the resin particles and other particles such as colored particles.

An example of another method for preparing the toner is as follows: a colorant is added to a polymerizable monomer and various constituting materials such as a mold-releasing agent, a charge controlling agent and a polymerization initiator are further added according to necessity. Then the constituting materials were dissolved or dispersed in the monomer by a means such as a homogenizer, a sand mill, a sand grinder and an ultrasonic dispersing apparatus. The polymerizable monomer in which the constituting materials are dissolved or dispersed is dispersed in an aqueous medium containing a dispersion stabilizer by Homomixer or a homogenizer so that the monomer is dispersed into oil droplets having a desired size. And then the polymerization reaction is progressed. After finishing the reaction, the dispersion stabilizer is removed, and the particles are separated by filtration, washed and dried to prepare the toner according to the invention.

The aqueous medium comprises at least 50% by weight of water.

A method for preparing said toner may includes one in which resinous particles are associated, or fused, in a water based medium. Example of the method includes, for example, method described in Japanese Patent Publication Open to Public Inspection No. 5-265252, 6-329947, or 9-15904.

It is possible to form the toner of the present invention by employing a method in which at least two of the dispersion particles of components such as resinous particles, colorants, and the like, or fine particles, comprised of resins, colorants, and the like, are associated, specifically in such a manner that after dispersing these in water employing emulsifying agents, the resultant dispersion is salted out by adding coagulants having a concentration of at least the critical coagulating concentration, and simultaneously the formed polymer itself is heat-fused at a temperature higher than the glass transition temperature, and then while forming said fused particles, the particle diameter is allowed gradually to grow; when the particle diameter reaches the desired value, particle growth is stopped by adding a relatively large amount of water; the resultant particle surface is smoothed while being further heated and stirred, to control the shape and the resultant particles which incorporate water, is again heated and dried in a fluid state. Further, herein, organic solvents, which are infinitely soluble in water, may be simultaneously added together with said coagulants.

Those which are employed as polymerizable monomers to constitute resins include styrene and derivatives thereof such as styrene, o-methylstyrene, m-methylstyrene, p-methylstyrene, α-methylstyrene, p-chlorostyrene, 3,4-dichlorostyrene, p-phenylstyrene, p-ethylstryene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butylacrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, vinylidene fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; as well as derivatives of acrylic acid or methacrylic acid such as acrylonitrile, methacrylonitrile, acryl amide, and the like. These vinyl based monomers may be employed individually or in combinations.

Further preferably employed as polymerizable monomers, which constitute said resins, are those having an ionic dissociating group in combination, and include, for instance, those having substituents such as a carboxyl group, a sulfonic acid group, a phosphoric acid group, and the like as the constituting group of the monomers. Specifically listed are acrylic acid, methacrylic acid, maleic acid, itaconic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, 3-chlor-2-acid phosphoxypropyl methacrylate, and the like.

Further, it is possible to prepare resins having a bridge structure, employing monomers having a plurality of vinyl groups such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, neopentyl glycol diacrylate, and the like.

Chain Transfer Agent

Chain transfer agents may be employed for a purpose of controlling molecular weight.

As the chain transfer agent, octyl mercaptan, dodecyl mercaptan, mercaptan of tert-dodecyl mercaptan,3-mercaptopropionic ester, carbontertrabromide, styrene dimer etc. are employed.

Polymerization Initiator

It is possible to polymerize these polymerizable monomers employing radical polymerization initiators. Listed as such water-soluble polymerization initiators may be persulfate salts, such as potassium persulfate, ammonium persulfate, azo compound such as 4,4' azobis-4-cyanovaleic acid, its salt, 2,2'-azobis(2-aminodipropane) salt, and a peroxide compound.

Further, the above-mentioned radical polymerization initiator can be combined with a reducing agent to become a redox initiator. By the use of a redox initiator, it is exhibited a desirable effect such that polymerization activity is enhanced, lowering of the polymerization temperature can be achieved, and further, the shortening of the polymerization time can be accomplished.

The polymerization temperature is not limited to a particular one so long as it is not lower than the lowest radical generation temperature of the polymerization initiator; for example, it falls within a range of 50° C. to 90° C. However, by the use of a polymerization initiator capable of starting at the normal temperature composed of the combination of hydrogen peroxide and a reducing agent (ascorbic acid etc.), it is possible to make polymerization at the room temperature or a temperature higher than that.

Surfactant

In order to practice particularly a mini-emulsion polymerization by the use of the above-mentioned polymerizable monomer, it is desirable to carry out an oil drop dispersion in an aqueous medium by the use of a surfactant. For a surfactant which can be used in this case, although it is not limited to particular one, the following ionic surfactants can be cited as examples of suitable compound.

For the ionic surfactant, for example, sulfonic acid salts (sodium dodecylbenzenesulfonate, sodium arylalkylpolyethersulfonate, sodium 3,3-disulfonediphenylurea-4,4-diazobis-amino-8-naphthol-6-sulfonate, orthocarboxybenzene-azo-dimethylaniline, sodium 2,2,5,5-tetramethyltriphenylmethane-4,4-diazo-bis-β-naphthol-6-sulfonate, etc.), sulfuric acid salt esters (sodium dodecylsulfate, sodium tetradecylsulfate, sodium pentadecylsulfate, sodium octylsulfate, etc.), and fatty acid salts (sodium oleate, sodium laurate, sodium caprate, sodium caprylate, sodium capronate, potassium stearate, calcium oleate, etc.) can be cited.

Further, in addition to the above, a nonionic surface active agent can be used. To state it concretely, polyethylene oxide, polypropylene oxide, a combination of polypropylene oxide and polyethylene oxide, ester of polyethylene glycol and higher fatty acid, alkylphenolpolyethylene oxide, ester of higher fatty acid and polyethylene glycol, ester of higher fatty acid and polypropylene oxide, sorbitan ester, etc. can be cited.

Further, these surface active agents are used mainly at the time of emulsion polymerization, but they may be used in some other processes or for other purposes.

In the present invention, preferred as excellent resins are those having a glass transition point of 20 to 90° C. as well as a softening point of 80 to 220° C. Said glass transition point is measured employing a differential thermal analysis method, while said softening point can be measured employing an elevated type flow tester. Preferred as these resins are those having a number average molecular weight (Mn) of 1,000 to 100,000, and a weight average molecular weight (Mw) of 2,000 to 100,000, which can be measured employing gel permeation chromatography. Further preferred as resins are those having a molecular weight distribution of Mw/Mn of 1.5 to 100, and is most preferably between 1.8 and 70.

The coagulants employed in the present invention are preferably selected from metallic salts. Listed as metallic salts, are salts of monovalent alkali metals such as, for example, sodium, potassium, lithium, etc.; salts of divalent alkali earth metals such as, for example, calcium, magnesium, etc.; salts of divalent metals such as manganese, copper, etc.; and salts of trivalent metals such as iron, aluminum, etc. Some specific examples of these salts are described below. Listed as specific examples of monovalent metal salts, are sodium chloride, potassium chloride, lithium chloride; while listed as divalent metal salts are calcium chloride, zinc chloride, copper sulfate, magnesium sulfate, manganese sulfate, etc., and listed as trivalent metal salts, are aluminum chloride, ferric chloride, etc. Any of these are suitably selected in accordance with the application.

The coagulant is preferably added not less than the critical coagulation concentration. The critical coagulation concentration is an index of the stability of dispersed materials in an aqueous dispersion, and shows the concentration at which coagulation is initiated. This critical coagulation concentration varies greatly depending on the fine polymer particles as well as dispersing agents, for example, as described in Seizo Okamura, et al, Kobunshi Kagaku (Polymer Chemistry), Vol. 17, page 601 (1960), etc., and the value can be obtained with reference to the above-mentioned publications. Further, as another method, the critical coagulation concentration may be obtained as described below. An appropriate salt is added to a particle dispersion while changing the salt concentration to measure the ζ potential of the dispersion, and in addition the critical coagulation concentration may be obtained as the salt concentration which initiates a variation in the ζ potential.

The concentration of coagulant may be not less than the critical coagulation concentration. However, the amount of the added coagulant is preferably at least 1.2 times of the critical coagulation concentration, and more preferably 1.5 times.

It is necessary after the fusion to stop the particle glowing at the time when the particle diameter is become to the desired value. For such the purpose, additional addition of the metal salt or water can be applied. In the case of the addition of the metal salt, a mono-valent metal salt such as sodium chloride and calcium chloride may be used. The adding amount of the metal salt may be an amount capable of stopping the particle glowing even though the amount is not specifically limited.

As the means for obtaining the particle diameter distribution according to the invention, for example, controlling by classification, and controlling by the temperature and the time for the association of the particles and the method for stopping the association are applicable.

The preferable preparation method include methods by controlling the association time, association temperature and the stopping rate in the aqueous medium. When a salting out/fusion process is performed, it is preferred that the standing time after the addition of the salting out agent is made as short as possible. Even though the reason of such the problem is not cleared yet, the situation of the coagulation of the particles is varied during the standing period after the salting out treatment so that problems are raised such as that the particle diameter distribution is become instable or the surface properties of the fused toner particle is varied. The temperature on the occasion of the addition of the salting out agent is not specifically limited.

It is preferred in the invention that the temperature of the resin particle dispersion is raised as fast as possible to a temperature higher than the glass transition point of the resin particle. The time for raising the temperature is preferably less than 30 minutes, and is more preferably less than 10 minutes. Moreover, it is necessary to rapidly raise the temperature; the raising rate is preferably not less than 1° C./minute. The upper limit of the raising rate is not cleared, a rate of not less than 15° C. is preferred from the viewpoint of inhibition of the formation of coarse particles caused by the rapidly progress of the salting out/fusion. It is particularly preferred that the progress of the salting out/fusion is continued after the temperature is arrived at the glass transition point of the resin.

The formation of the particle having a diameter of not more than 2 μm can be inhibited by employing a di- or more. valent metal salt for the salting out/fusion. It is presumed that the repulsive force at the salting out is raised by the use of the di- or more valent metal salt and the dispersion ability of the surfactant can be effectively inhibited so that the entire particles can be associated and the particle distribution can be controlled, even though the reason of such the effect is not cleared yet.

It is preferred to progress the salting out and the fusion at the same time for controlling the particle size according to the invention. The uniformity of the particle shape tends to be lowered and the formation of the fine particle cannot be inhibited by the method in which the coagulated particles are formed once and the heated. It is presumed that the fine particles are difficultly formed since each the coagulated particles are each difficultly re-divided when the coagulated particles are heated in the aqueous medium while stirring.

The toner of the present invention is comprised of at least resins, colorants and releasing agents, and further, if desired, charge control agents, and the like. Further, said toner may be one to which external additives, comprised of fine inorganic particles, fine organic particles, and the like, are added.

Colorant

Examples of colorants include carbon black, magnetic materials, dyes, pigments, and the like. Employed as carbon blacks are channel black, furnace black, acetylene black, thermal black, lamp black, and the like. Employed as ferromagnetic materials may be ferromagnetic metals such as iron, nickel, cobalt, and the like, alloys comprising these metals, compounds of ferromagnetic metals such as ferrite, magnetite, and the like, alloys which comprise no ferromagnetic metals but exhibit ferromagnetism upon being thermally treated such as, for example, Heusler's alloy such as manganese-copper-aluminum, manganese-copper-tin, and the like, and chromium dioxide, and the like.

Employed as dyes may be C.I. Solvent Red 1, the same 49, the same 52, the same 63, the same 111, the same 122, C.I. Solvent Yellow 19, the same 44, the same 77, the same 79, the same 81, the same 82, the same 93, the same 98, the same 103, the same 104, the same 112, the same 162, C.I. Solvent Blue 25, the same 36, the same 60, the same 70, the same 93, the same 95, and the like, and further mixtures thereof may also be employed. Employed as pigments may be C.I. Pigment Red 5, the same 48:1, the same 53:1, the same 57:1, the same 122, the same 139, the same 144, the same 149, the same 166, the same 177, the same 178, the same 222, C.I. Pigment Orange 31, the same 43, C.I. Pigment Yellow 14, the same 17, the same 93, the same 94, the same 138, C.I. Pigment Green 7, C.I. Pigment Blue 15:3, the same 60, and the like, and mixtures thereof may be employed. The number average primary particle diameter varies widely depending on their types, but is preferably between about 10 and about 200 nm.

Further, added as releasing agents may be low molecular weight polypropylene (having a number average molecular weight of 1,500 to 9,000), low molecular weight polyethylene, and the like. Further, ester type wax such as an ester of higher carboxylic acid and long chain alcohol and polyvalent ester of a higher carboxylic acid and a polyalcohol, carnauba wax, and candelilla wax are listed.

Suitable example are given by the following formula.

$$R^1—(OCO—R^2)_n$$

In the formula n represents an integer of 1 to 4, and preferably 2 to 4, more preferably 3 or 4, and in particular preferably 4.

$R^1$ and $R^2$ each represent a hydrocarbon group which may have a substituent respectively. $R^1$ has from 1 to 40 carbon atoms, and preferably 1 to 20, more preferably 2 to 5.

$R^2$ has from 1 to 40 carbon atoms, and preferably 13 to 29, more preferably 12 to 25.

The representative examples are listed.

$$CH_3—(CH_2)_{12}—COO—(CH_2)_{17}—CH_3 \quad (1)$$

$$CH_3—(CH_2)_{18}—COO—(CH_2)_{17}—CH_3 \quad (2)$$

$$CH_3—(CH_2)_{20}—COO—(CH_2)_{21}—CH_3 \quad (3)$$

$$CH_3—(CH_2)_{14}—COO—(CH_2)_{19}—CH_3 \quad (4)$$

$$CH_3—(CH_2)_{20}—COO—(CH_2)_6—O—CO—(CH_2)_{20}—CH_3 \quad (5)$$

6)

$$CH_3—(CH_2)_{20}—COO—(CH_2)_2—\underset{}{\overset{CH_3}{\overset{|}{CH}}}—CH_2—O—CO—(CH_2)_{20}—CH_3$$

7)

$$CH_3—(CH_2)_{22}—COO—(CH_2)_2—\overset{CH_3}{\overset{|}{CH}}—CH_2—O—CO—(CH_2)_{22}—CH_3$$

-continued

8)

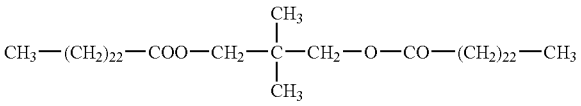

9)

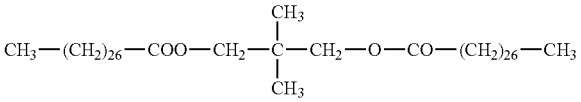

10)

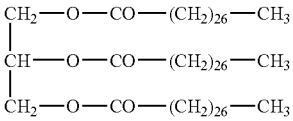

11)

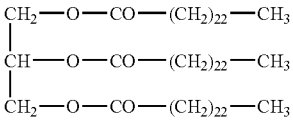

12)

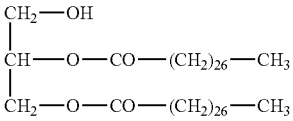

13)

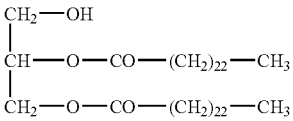

14)

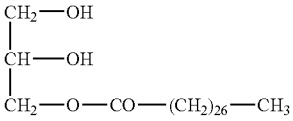

15)

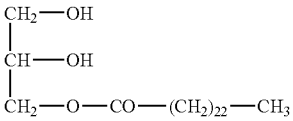

16)

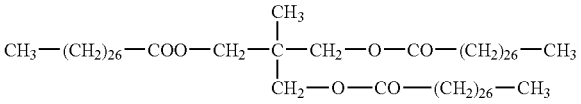

17)

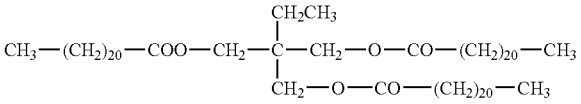

18)

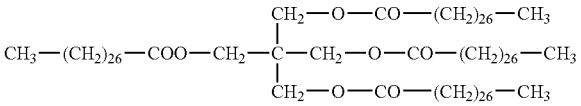

19)

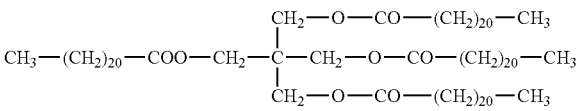

-continued

20)

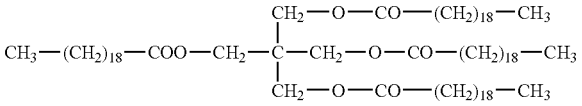

21)

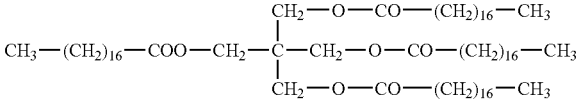

22)

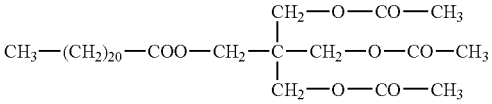

The releasing agent is added in an amount of between 2 and 20 percent by weight, and is preferably between 3 and 15 percent by weight.

Addition of an ester wax improves transfer characteristics in addition to an affect to fixing characteristics. Though the reason is not clear, however it is supposed that a very few amount of wax moves from toner surface to a photoreceptor during development or cleaning, and it reduces the surface energy of the photoreceptor to obtain an improved transfer characteristics.

The releasing agents can be incorporated in the toner particle in such a way that the releasing agent and the resin particles are subjected to salting out/fusing as well as colored particles, or the releasing agent is dissolved in a monomer to form resin particles and then the monomer is polymerized.

Other Additives

Besides colorants and releasing agents, materials, which provide various functions as toner materials may be incorporated into the toner of the present invention. Specifically, charge control agents are cited. Said agents may be added employing various methods such as one in which during the salting-out/fusion stage, said charge control agents are simultaneously added to resinous particles as well as colorant particles so as to be incorporated into the toner, another is one in which said charge control agents are added to resinous particles, and the like.

In the same manner, it is possible to employ various charge control agents, which can be dispersed in water. Specifically listed are nigrosine based dyes, metal salts of naphthenic acid or higher fatty acids, alkoxyamines, quaternary ammonium salts, azo based metal complexes, salicylic acid metal salts or metal complexes thereof.

It is preferable that the number average primary particle diameter of particles of said charge control agents as well as said fixability improving agents is adjusted to about 10 to about 500 nm in the dispersed state.

The toner of the present invention exhibits more desired effects when employed after having added fine particles such as fine inorganic particles, fine organic particles, and the like, as external additives. The reason is understood as follows: since it is possible to control burying and releasing of external additives, the effects are markedly pronounced.

Preferably employed as such fine inorganic particles are inorganic oxide particles such as silica, titania, alumina, and the like. Further, these fine inorganic particles are preferably subjected to hydrophobic treatment employing silane coupling agents, titanium coupling agents, and the like. The degree of said hydrophobic treatment is not particularly limited, but said degree is preferably between 40 and 95 in terms of the methanol wettability. The methanol wettability as described herein means wettability for methanol. The methanol wettability is measured as follows. 0.2 g of fine inorganic particles to be measured is weighed and added to 50 ml of distilled water, in a beaker having an inner capacity of 200 ml. Methanol is then gradually dripped, while stirring, from a burette whose outlet is immersed in the liquid, until the entire fine inorganic particles are wetted. When the volume of methanol, which is necessary for completely wetting said fine inorganic particles, is represented by "a" ml, the degree of hydrophobicity is calculated based on the formula described below:

$$\text{Degree of hydrophobicity}=[a/(a+50)]\times 100$$

The added amount of said external additives is generally between 0.1 and 5.0 percent by weight with respect to the toner, and is preferably between 0.5 and 4.0 percent. Further, external additives may be employed in combinations of various types.

<Image Forming Member or Photoreceptor>

In almost cases, the image forming member is an electrophotographic photoreceptor. As the photoreceptor, organic photoreceptors, amorphous silicon photoreceptor and organic photoreceptors are employable. The organic photoreceptors are particularly preferred and that having a multi-layer structure comprising a charge transfer layer and a charge generation layer is preferred. A belt-type photoreceptor is particularly preferable. In such the case, a plastic base, such as polyethylene terephthalate base, having a thin aluminum evaporated layer can be used by which the ultrasonic wave can be effectively propagated compared with the drum type photoreceptor employing an aluminum pipe.

The preferable embodiment of the belt of the PET base is one having a thickness of from 50 to 1,000 μm and covered with the evaporated or laminated aluminum layer, and the photoreceptor layer is basically constituted by a subbing layer, a charge transfer layer and a charge generation layer.

<Image Forming Method>

As a method forming the image on the image forming member, any method may be applied without any limitation, for example, a method in which the plural images are formed on the photoreceptor and transferred at once and a method in which images formed on the photoreceptor are successively transferred to a transfer belt are utilized.

It is more preferable that the plural images are formed on the photoreceptor and directly transferred onto the image supporting material or the intermediate transfer member at once since the effects of the invention can be enhanced in such the method.

It is resumed that the effect of the ultrasonic wave is effectively enhanced for improving the color reproducibility and the gradation when the amount of the toner to be transferred is large.

The following procedure is carried out in such the method: The photoreceptor is uniformly charged, and exposed to light corresponding to the first image, and developed to form the first toner image on the photoreceptor; the photoreceptor carrying the first toner image is uniformly charged and exposed to light corresponding to the second image and then secondly developed to form the second toner image; the photoreceptor carrying the first and the second toner images is uniformly charged and exposed to light corresponding to the third image and then thirdly developed to form the third toner image; and then the photoreceptor carrying the first, second and third toner images is uniformly charged and exposed to light corresponding to the fourth image and fourthly developed to form the fourth toner image.

For example, a full color toner image is formed on the photoreceptor by applying a yellow toner for the first development, a magenta toner for the second development, a cyan toner for the third development and a black toner for the fourth development.

Thereafter, the toner image formed on the photoreceptor is transferred at once onto the image supporting material such as paper and fixed to form a finished image.

In the method, the image composed of images each having the colors different from each other formed on the photoreceptor is transferred at once onto the support such as paper. Accordingly, the degradation of the image quality can be inhibited since the transferring process causing the distortion of the image is performed only one time, different from the method so called as an intermediate transfer method.

For developing the latent image on the photoreceptor, a non-contact development is preferred since plural times of development are required. A method is also preferable, in which alternative electric field is applied on the occasion of the development.

The image forming method according to the invention, the image forming member conveying a toner image carried thereon to the transfer zone is overlapped with the image supporting material in the transfer zone so that the toner image is between the image forming member and the image supporting material, and an electric field is applied between the image forming member and the image supporting material, and ultrasonic wave having a designated wavelength is irradiated at the same time from an ultrasonic wave generation means arranged at a position so as to face without contact to the image forming member overlapped with the image supporting material between them the toner image is put to transfer the toner image onto the image supporting material, and the toner image is finally fixed to form an image. The transferred toner image may be transferred again to recording paper and fixed onto it.

The ultrasonic wave irradiation face from which the ultrasonic wave is irradiated by the ultrasonic generation means is held so as to be parallel with the surface facing to the ultrasonic wave irradiation face, and the distance between the ultrasonic wave irradiation face to the surface facing to it is adjusted to an integer times ½ of the wave length of the ultrasonic wave. The ultrasonic wave is irradiated from the ultrasonic wave irradiation means.

The frequency of the ultrasonic wave is preferably from 20 kHz to 2 MHz.

It is preferable that the ultrasonic wave irradiation means is arranged at the lower stream side or the toner image conveying direction so as to be adjacent to the electric field applying means.

More over, it is preferable to arrange a vibration propagation preventing means for preventing the propagation of the vibration given to the image forming member and the image supporting material to outside the image transfer zone at least one or both of the upper and lower stream position of the toner image conveying direction.

FIG. 1 is the cross section of a full color image forming apparatus relating to the invention.

Charging device 2Y, 2M, 2C and 2Bk each uniformly charging for the yellow, magenta, cyan and black image formation, respectively, are arranged around a photoreceptor 1K. Further, exposure device 2Y, 3M, 3C and 3Bk and developing device 4Y, 4M, 4C and 4Bk each for exposing and developing the yellow, magenta, cyan and black images, respectively, are similarly arranged as shown in FIG. 1.

A yellow unit image is formed on the photoreceptor 1K by the uniform charging device 2Y, the image exposure device 3Y, and the developing device 4Y. The method for forming the image is the same as in the manner as in monochromatic image formation. The photoreceptor face is uniformly charged by the uniform charging device 2Y and image wise exposed to light by the image exposure device 3Y, and then developed by the developing device in which a yellow toner is charged to form the yellow image.

Magenta, cyan and black images are each formed at the same area of the photoreceptor synchronizing with the rotating motion of the photoreceptor to form a full color toner image composed of overlapping of each color toners.

When the image formed portion of the photoreceptor 1K is arrived at the portion of a transferring device 5T and an ultrasonic wave apparatus 7U, the color toner image is transferred onto an image supporting material P conveyed adjusting the timing, and the image supporting material carrying the color image is conveyed to a fixing device 6F. Thus the color image is fixed onto the image supporting material.

The photoreceptor is further rotated after the transfer of the toner image, and the toner and paper powder remained on the photoreceptor surface are removed by a cleaning device 8C having a blade 8B to reuse the photoreceptor for image formation.

A good image cannot be formed by the usual toner having a wide distribution of particle diameter and shape since color mixing occurs. Contrary to that, a satisfactory image can be formed by the toner according to the invention since the toner has uniform particle diameter and the shape and the differences of the charging amount and the adhesive force between each of the toner particles are small, therefore the color mixing is not caused and the advantage of the collective transfer method can be sufficiently applied, by which the number of the transfer and the deformation of image accompanied with the transfer are become small.

The belt-shaped photoreceptor is preferable for utilizing the constitution of the image forming apparatus such as that shown in FIG. 1.

<Developing Method>

The toner relating to the image forming method according to the invention may be suitably employed as a single-component magnetic toner containing a magnetic material, a double-component developer by mixing with a carrier and a non-magnetic toner for single use. The use as the double component developer by mixing with the carrier is preferred.

In the developing method by forming the piled color image and collectively transfer the image, a non-contact developing method is preferred. A typical developing device for such the developing method is shown in FIG. 2.

Figure 2:
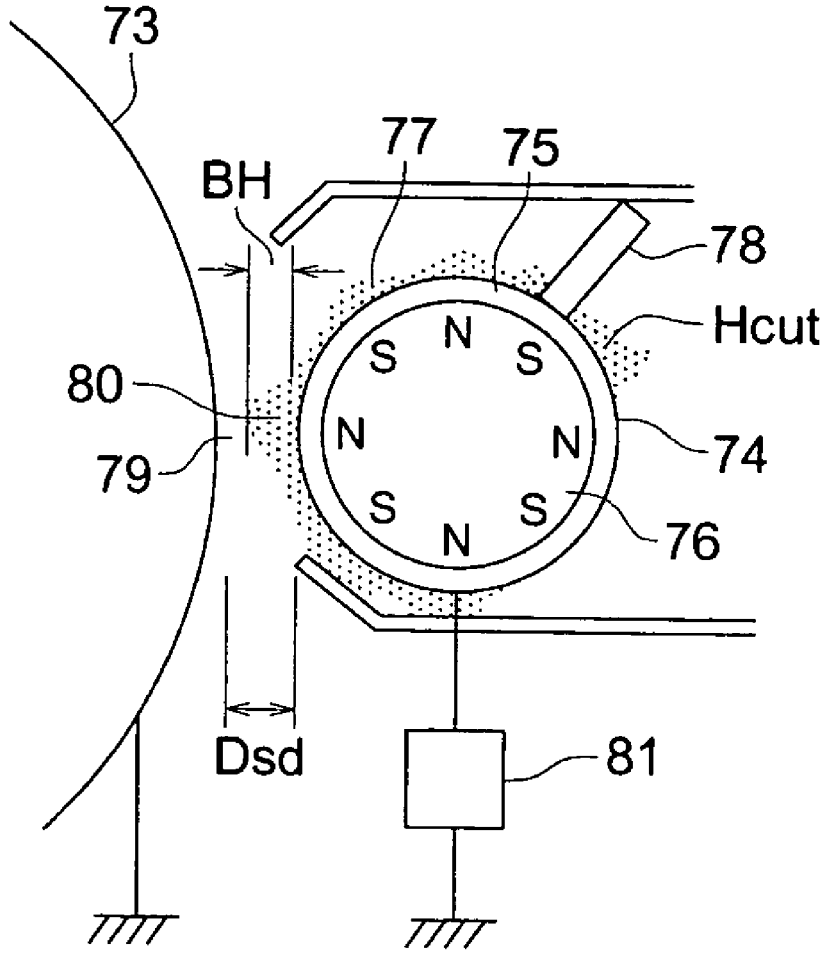
FIG. 2 displays the schematic drawing of the principal part of a developing device for non-contact development.

FIG. 2 is a schematic drawing of the principal part of the non-contact developing device suitably employed or the image forming method according to the invention, in which 73 is a photoreceptor, 74 is a developer carrying member, 75 is a sleeve, 77 is a double-component developer containing the toner according to the invention, 78 is a developer layer regulating member, 79 is a developing zone, 80 is a developer layer and 81 is a power source for forming an alternative electric field.

The double-component developer 77 containing the toner according to the invention is carried by the magnetic force of the developer carrying member 74 having a magnet 76 therein, and conveyed into the developing zone 79 by the motion of the sleeve 75. On the accession of the conveying, the thickness of the developer layer 80 (shown as Hcut) is regulated by a developer layer regulating member 78 so that the developer layer is not contacted to the photoreceptor 73.

The minimum space Dsd in the developing zone 79 is, for example, preferably from about 100 to 1,000 μm, and is more preferably from 100 to 500 μm, which is larger than the thickness of the developer layer 80 (shown as BH) conveyed into the developing zone. The thickness of the conveyed developer layer is preferably about 50 to 300 μm.

The power source 81 is a power source for forming the alternative electric field, and the alternative electric field preferably has a frequency of from 200 to 8,000 Hz and a voltage of from 500 to 3,000 $V_{p-p}$. A direct current may be added in series to the alternative current according to necessity. In such the case, the voltage of the direct current is preferably from 300 to 800 V.

The volume average diameter of the carrier employable in the double-component developer is from 15 to 100 μm, and more preferably from 25 to 60 μm. The volume average diameter of the carrier can be measured typically by a laser diffraction particle size distribution measuring apparatus having a wet dispersing device HELOS, manufactured by Sympatic Co., Ltd.

As the carrier, a resin coated carrier and a resin dispersed type carrier comprising magnetic particles dispersed in resin are preferred. As the resin for coating the carrier, for example, olefin based resins, styrene based resins, styrene/acryl based resins, silicone based resins, ester based resins and fluorine-containing polymer based resins are employed. As the resin for the resin dispersion carrier, for example, styrene/acryl based resins, polyester based resins, fluorinated resins and phenol based resins are employable.

<Cleaning Device>

A blade cleaning device utilizing a counter method is preferably employed. As the material of the blade, butadiene rubber, urethane rubber and silicone rubber are usable. The urethane rubber is particularly preferred. The blade having a thickness of from 1.5 to 6.0 mm and a free length of about 2 to 30 mm is employed.

<Mixing Method>

Contact heating method is suitably utilized as the fixing method. Typical examples of the contact heating method include a heating roller fixing method and a pressing and heating fixing method by a rotatable pressing member including a fixedly provided heating means.

EXAMPLES

The constitution and the effects of the invention are concretely described referring typical examples of embodiment of the invention.

In the followings, the "part" is the part in weight.

Preparation Example of Latex 1

In a 5,000 ml separable flask to which a stirring device, a temperature sensor, a cooler, and a nitrogen gas introducing device were attached, an aqueous solution of 7.08 g of an anionic surfactant, sodium dodecylbenzenesulfonate (SDS); dissolved in 2760 g of deionized water was previously charged. The temperature of the content was raised by 80°

C. while stirring at a speed of 230 rpm under nitrogen gas stream. On the other hand, 72.0 g of a mold-releasing agent having the structure of Exemplified compound 19 was added to a monomer mixture composed of 115.1 g of styrene, 42.0 g of n-butyl acrylate and 10.9 g of methacrylic acid and dissolved by heating up by 80° C. to prepare a monomer solution. The above solutions were mixed and dispersed by a mechanical dispersion machine having a circulation pass to prepare emulsified particles each having an uniform particle diameter. Then a solution of 0.84 g of a polymerization initiator, potassium persulfate (KPS), dissolved in 200 g of deionized water was added and heated and stirred for 3 hours at 80° C. to form latex particles. Thereafter, a solution of 7.73 g of polymerization initiator KPS dissolved in 240 ml of deionized water was further added. After 15 minutes, a mixture of 383.6 g of styrene of n-butyl acrylate, 36.4 g of methacrylic acid and 14.o g of n-octylmercaptane was dropped at 80° C. spending for 120 minutes. After finish of the dropping, the heating and stirring continued for 60 minutes, and then cooled by 40° C. Thus latex particles were obtained.

The resultant latex particles were referred to as Latex 1.

Preparation Example of Colored Particles

Colored Particle 1Bk

In 160 ml of deionized water, 9.2 g of sodium n-dodecylsulfate was dissolved by stirring, To the resultant solution, 20 g of Regal 330R, carbon black manufactured by Cabot Co., Ltd., was gradually added and dispersed by Cleamix. The diameter of the dispersed particle was measured by an electrophoresis light scattering photometer ELS-800, manufactured by Ootsuka Denshi Co., Ltd. The weight average diameter of the dispersed particles was 112 nm. The dispersion was referred to as Colorant Dispersion 1.

Into a 5 litter four-mouth flask, to which a thermal sensor, a cooler, a nitrogen gas introducing device and a stirrer, 1250 g of Latex 1, 2,000 ml of deionized water and the foregoing Colorant Dispersion 1 were charged and stirred. The temperature of the content was adjusted to 30° C. and the pH was adjusted to 10.0 by a 5 moles/liter aqueous solution of sodium hydroxide.

Then an aqueous solution of 56 g of magnesium chloride hexahydrate dissolved in 72 ml of deionized water added spending 5 minutes at 30° C. while stirring. After that, the mixture was stood for 2 minutes and heated by 85° C. spending 5 minutes in the temperature raising rate of 12° C. per minute. The particle diameter was measured in such the situation by Coulter Counter TA-II. An aqueous solution of 115 g of sodium chloride dissolved in 700 ml of deionized water was added to stop the glowing of the particles at the time when the volume average diameter of the dispersed particles was arrived at 5.3 μm. Further, the dispersion was heated and stirred for 8 hours at a temperature of 90° C.±2° C. for salting out and fusing the particles. After that, the dispersion was cooled by 30° C. in a rate of 6° C. per minute and the pH of the dispersion was adjusted to 2.0 by the addition of hydrochloric acid, and then stirring was stopped.

Thus prepared colored particles were filtered and washed under the later-mentioned conditions and fried by warmed air at 40° C. to obtain colored particles. The resultant color particle was referred to as Colored Particle 1Bk.

Colored Particle 1Y

Colored Particle 1Y was prepared in the same manner as in Colored Particle 1Bk except that C.I. Pigment Yellow 185 was employed in place of the carbon black.

Colored Particle 1M

Colored Particle 1M was prepared in the same manner as in Colored Particle 1Bk except that C.I. Pigment Red 122 was employed in place of the carbon black.

Colored Particle 1C

Colored Particle 1C was prepared in the same manner as in Colored Particle 1Bk except that C.I. Pigment Blue 15:3 was employed in place of the carbon black.

Furthermore, Colored Particle 2Bk through 6C were prepared in which the amount of magnesium chloride, the temperature raising rate, the liquid temperature at salting out/fusion and the holding time were changed as shown in Table 1.

TABLE 1

| | Added amount | | Salting out/Fusion | |
|---|---|---|---|---|
| Colored Particle No. | of magnesium chloride | Temperature raising rate | Liquid temp. | Holding time |
| Colored Particle 1Bk | 56 g | 12° C./minute | 85 ± 2° C. | 8 hours |
| Colored Particle 1Y | 56 g | 12° C./minute | 85 ± 2° C. | 8 hours |
| Colored Particle 1M | 56 g | 12° C./minute | 85 ± 2° C. | 8 hours |
| Colored Particle 1C | 56 g | 12° C./minute | 85 ± 2° C. | 8 hours |
| Colored Particle 2Bk | 56 g | 15° C./minute | 90 ± 2° C. | 6 hours |
| Colored Particle 2Y | 56 g | 15° C./minute | 90 ± 2° C. | 6 hours |
| Colored Particle 2M | 56 g | 15° C./minute | 90 ± 2° C. | 6 hours |
| Colored Particle 2C | 56 g | 15° C./minute | 90 ± 2° C. | 6 hours |
| Colored Particle 3Bk | 56 g | 5° C./minute | 90 ± 2° C. | 6 hours |
| Colored Particle 3Y | 56 g | 5° C./minute | 90 ± 2° C. | 6 hours |
| Colored Particle 3M | 56 g | 5° C./minute | 90 ± 2° C. | 6 hours |
| Colored Particle 3C | 56 g | 5° C./minute | 90 ± 2° C. | 6 hours |
| Colored Particle 4Bk | 28 g | 12° C./minute | 85 ± 2° C. | 8 hours |
| Colored Particle 4Y | 28 g | 12° C./minute | 85 ± 2° C. | 8 hours |
| Colored Particle 4M | 28 g | 12° C./minute | 85 ± 2° C. | 8 hours |
| Colored Particle 4C | 28 g | 12° C./minute | 85 ± 2° C. | 8 hours |
| Colored Particle 5Bk | 84 g | 12° C./minute | 85 ± 2° C. | 8 hours |
| Colored Particle 5Y | 84 g | 12° C./minute | 85 ± 2° C. | 8 hours |
| Colored Particle 5M | 84 g | 12° C./minute | 85 ± 2° C. | 8 hours |
| Colored Particle 5C | 84 g | 12° C./minute | 85 ± 2° C. | 8 hours |
| Colored Particle 6Bk | 56 g | 12° C./minute | 85 ± 2° C. | 8 hours |
| Colored Particle 6Y | 56 g | 12° C./minute | 85 ± 2° C. | 8 hours |
| Colored Particle 6M | 56 g | 12° C./minute | 85 ± 2° C. | 8 hours |
| Colored Particle 6C | 56 g | 12° C./minute | 85 ± 2° C. | 8 hours |

TABLE 2

| Colored Particle No. | Volume average particle diameter | Number ratio of particles less than 2 μm (%) |
|---|---|---|
| Colored Particle 1Bk | 5.4 μm | 0.3% |
| Colored Particle 1Y | 5.4 μm | 0.3% |
| Colored Particle 1M | 5.4 μm | 0.3% |
| Colored Particle 1C | 5.4 μm | 0.3% |
| Colored Particle 2Bk | 5.4 μm | 0.1% |
| Colored Particle 2Y | 5.4 μm | 0.1% |
| Colored Particle 2M | 5.4 μm | 0.1% |
| Colored Particle 2C | 5.4 μm | 0.1% |
| Colored Particle 3Bk | 5.4 μm | 0.9% |
| Colored Particle 3Y | 5.4 μm | 0.9% |
| Colored Particle 3M | 5.4 μm | 0.9% |
| Colored Particle 3C | 5.4 μm | 0.9% |
| Colored Particle 4Bk | 4.2 μm | 0.5% |
| Colored Particle 4Y | 4.2 μm | 0.5% |
| Colored Particle 4M | 4.2 μm | 0.5% |
| Colored Particle 4C | 4.2 μm | 0.5% |
| Colored Particle 5Bk | 6.4 μm | 0.1% |
| Colored Particle 5Y | 6.4 μm | 0.1% |
| Colored Particle 5M | 6.4 μm | 0.1% |
| Colored Particle 5C | 6.4 μm | 0.1% |
| Colored Particle 6Bk | 7.4 μm | 0.1% |
| Colored Particle 6Y | 7.4 μm | 0.1% |
| Colored Particle 6M | 7.4 μm | 0.1% |
| Colored Particle 6C | 7.4 μm | 0.1% |

Comparative Colored Particle 1Bk

One hundred parts of styrene/acryl resin, 10 parts of Exemplified Compound 19 and 10 parts of the carbon black were mixed in dry state, and then the resultant mixture was melted, kneaded and crushed. Thus colored particles having a volume average diameter of 7.5 μm were obtained. The content of the particles having a diameter of not more than 2 μm was 16% in number. The colored particle was referred to as Comparative Colored Particle 1Bk.

Comparative Colored Particle 1Y

A yellow colored particle was prepared in the same manner as in Comparative Colored particle 1Bk except that C.I. Pigment Yellow 185 was employed in place of the carbon black. The volume average diameter of the colored particle was 7.6 μm and the content of particles having a diameter of not more than 2 μm was 17% in number. Thus obtained colored particle was referred to as Comparative Colored Particle 1Y.

Comparative Colored Particle 1M

A yellow colored particle was prepared in the same manner as in Comparative Colored particle 1Bk except that C.I. Pigment Red 122 was employed in place of the carbon black. The volume average diameter of the colored particle was 7.6 μm and the content of particles having a diameter of not more than 2 μm was 18% in number. Thus obtained colored particle was referred to as Comparative Colored Particle 1M.

Comparative Colored Particle 1C

A yellow colored particle was prepared in the same manner as in Comparative Colored particle 1Bk except that C.I. Pigment Blue 15:3 was employed in place of the carbon black. The volume average diameter of the colored particle was 7.6 μm and the content of particles having a diameter of not more than 2 μm was 18% in number. Thus obtained colored particle was referred to as Comparative Colored Particle 1C.

Preparation of Toner

To each of the above Colored Particle 1Bk through Comparative Colored Particle 1C, 1% by weight of hydrophobic silica having a number average primary particle diameter of 12 nm and hydrophobicity of 68 and 0.5% by weight of hydrophobic titanium oxide having a number average primary particle diameter of 20 nm and a hydrophobicity of 63 were added and mixed by a Henschel mixer to prepare toners. The resultant toners were each referred to as Toner 1Bk through Comparative Toner 1C, respectively, according to the colored particles employed therein.

Regarding the physical properties such as the shape and the particle diameter, no difference was observed between each of the colored particles and the toners.

Preparation of Developer

To each of the toners, silicone resin coated ferrite carrier having a volume average diameter of 60 μm was mixed to prepare a developer having a toner concentration of 6%. Thus obtained developers were each referred to as Developer 1Bk through Comparative Developer 1C, respectively, according to the toner employed therein.

Image Forming Apparatus

The evaluation was performed by an image forming apparatus with the conditions given in FIG. 1, which has a non-contact developing devices having the constitution shown in FIG. 2.

The ultrasonic wave was irradiated under the condition of 40 kHz·5W.

The cleaning mechanism for the photoreceptor was a blade cleaning system, and the blade is provided according to the counter cleaning method.

The blade was made from urethane resin and has a thickness of 3 mm and a free length of 1,2 mm. The load applied to the blade was 10 mN/cm.

Evaluation

A full color image having a pixel ratio of 25% was printed for 200,000 sheet under a high temperature and high humidity condition at 33° C. and 80% RH, according to the above-mentioned image forming method; and the occurrence of image defect was evaluated.

TABLE 3

| Developer No. | Occurrence of image defect |
|---|---|
| Developer 1Bk/1Y/1M/1C | No filming occurred, fine image was formed. |
| Developer 2Bk/2Y/2M/2C | No filming occurred, fine image was formed. |
| Developer 3Bk/3Y/3M/3C | No filming occurred, fine image was formed. |
| Developer 4Bk/4Y/4M/4C | No filming occurred, fine image was formed. |
| Developer 5Bk/5Y/5M/5C | No filming occurred, fine image was formed. |
| Developer 6Bk/6Y/6M/6C | No filming occurred, fine image was formed. |
| Comparative Developer 1Bk/1Y/1N/1C | Filming occurred, black line defect occurred |

It is under stood that any defect is caused by the combination of the toners according to the invention, Developer 1Bk/1Y/1M/1C through Developer 6Bk/6Y/6M/6C. In contrast, the combination of the toners out of the invention Comparative Developer 1Bk/1Y/1M/1C caused image defects.

The image forming method can be provided by the invention, by which an image without any defect can be stably formed for a prolonged period by utilizing the ultrasonic wave transfer system capable of transferring a large amount of the toner with high efficiency.

The invention claimed is:

1. An image forming method comprising the steps of forming a toner image on an image forming member having a photosensitive material on a support, including steps of forming a latent image on the image forming member and developing the latent image by a developer comprising a toner and a carrier, conveying the image forming member carrying the toner image thereon into a predetermined transfer zone, overlapping an image supporting material so that the toner image is between the image forming member and the image supporting material, applying an electric field between the image forming member and the image supporting material, irradiating ultrasonic wave, on the occasion of the application of the electric field, to the image forming member and the image supporting material from an ultrasonic wave generating device arranged at a facing position so as not to contact to transfer the toner image onto the image supporting material, and fixing the toner image on the image supporting material, wherein a volume average particle diameter of the toner in the developer is from 3 to 8 μm, and a content of the toner particle having a diameter of not more than 2 μm is not more than 2% by number.

2. The image forming method of claim 1, wherein the toner image on the image forming member is composed of yellow, magenta, cyan and black toners.

3. The image forming method of claim 1, wherein frequency of the ultrasonic wave is from 20 kHz to 2 MHz.

4. The image forming method of claim 1, wherein the support is a plastic base having a thin aluminum evaporated layer.

5. The image forming method of claim 1, wherein content of the toner particle having a diameter of not more than 2 μm is not more than 1.5% by number.

6. The image forming method of claim 1, wherein the electric field is alternative.

7. The image forming method of claim 1, wherein the toner image is formed on an image forming member via a non-contact developing method.

8. The image forming method of claim 1, wherein the toner contains an releasing agent represented by formula of $$R^1—(OCO—R^2)_n,$$

wherein n represents an integer of 1 to 4, and $R^1$ and $R^2$ represent a hydrocarbon group which may have a substituent respectively.

* * * * *